US007250065B1

(12) United States Patent
Günther et al.

(10) Patent No.: US 7,250,065 B1
(45) Date of Patent: Jul. 31, 2007

(54) FUEL COMPOSITIONS CONTAINING PROPOXYLATE

(75) Inventors: Wolfgang Günther, Mettenheim (DE); Knut Oppenländer, Ludwigshafen (DE); Harald Schwahn, Wiesloch (DE); Irene Trötsch-Schaller, Bissersheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/720,257

(22) PCT Filed: Jul. 8, 1999

(86) PCT No.: PCT/EP99/04818

§ 371 (c)(1),
(2), (4) Date: Jan. 9, 2001

(87) PCT Pub. No.: WO00/02978

PCT Pub. Date: Jan. 20, 2000

(30) Foreign Application Priority Data

Jul. 9, 1998 (DE) ..... 198 30 818

(51) Int. Cl.
*C10L 1/18* (2006.01)
*C10L 1/22* (2006.01)

(52) U.S. Cl. ..... 44/443; 44/412

(58) Field of Classification Search ..... 44/412, 44/443, 432

See application file for complete search history.

(56) References Cited

U.S. PATENT DOCUMENTS

| | | | | |
|---|---|---|---|---|
| 3,901,665 | A | 8/1975 | Polss | |
| 4,832,702 | A | 5/1989 | Kummer et al. | |
| 5,004,478 | A * | 4/1991 | Vogel et al. | 44/398 |
| 5,006,130 | A | 4/1991 | Aiello et al. | 44/432 |
| 5,873,917 | A * | 2/1999 | Daly | 44/443 |
| 6,348,075 | B1 * | 2/2002 | Jackson | 44/432 |
| 2002/0014034 | A1 | 2/2002 | Bernasconi et al. | 44/329 |

FOREIGN PATENT DOCUMENTS

| | | |
|---|---|---|
| EP | 0 244 616 | 3/1987 |
| EP | 0 374 461 | 6/1990 |
| EP | 0 704 519 | 4/1996 |
| EP | 0 878 532 | 11/1998 |
| EP | 0 950 704 | 10/1999 |
| HU | P9602719 | 8/1997 |
| HU | P9903425 | 2/2000 |
| WO | WO 95/27021 | 10/1995 |

* cited by examiner

*Primary Examiner*—Cephia D. Toomer
(74) *Attorney, Agent, or Firm*—Oblon, Spivak, McClelland, Maier & Neustadt, P.C.

(57) ABSTRACT

Fuel compositions for internal combustion engines, comprising a principle amount of a liquid hydrocarbon fuel and an amount, which has a cleaning effect, of at least one propoxylate additive of the formula I (I)

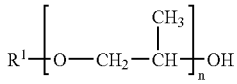

where
n is an integer from 10 to 20 and
$R^1$ is straight-chain or branched $C_8$-$C_{18}$-alkyl or $C_8$-$C_{18}$-alkenyl,
if required in combination with at least one detergent additive, e.g. a polyalkylamine additive of the formula II $$R^2—NH_2 \quad (II)$$

where
$R^2$ is a straight-chain or branched polyalkyl radical having a number average molecular weight of from about 500 to about 5000,
and fuel additive compositions which contain propoxylates of the formula I and, if required, further additives, such as the aforementioned polyalkylamines of the formula II, as intake valve cleaners.

12 Claims, No Drawings

FUEL COMPOSITIONS CONTAINING PROPOXYLATE

BACKGROUND OF THE INVENTION

1. Field of the Invention

The present invention relates to novel propoxylate-containing fuel compositions and novel additive concentrates.

2. Description of the Background

Carburetors and intake systems of gasoline engines as well as injection systems for fuel metering in gasoline and diesel engines are increasingly being contaminated by impurities. The impurities arise from dust particles from the air taken in by the engine, unburnt hydrocarbon residues from the combustion chamber and the vent gases from the crank case which are passed into the carburetor.

These residues shift the air/fuel ratio during idling and in the lower part-load range so that the mixture becomes richer and combustion less complete. As a result of this, the proportion of uncombusted or partially combusted hydrocarbons in the exhaust gas increases and the gasoline consumption rises.

It is known that these disadvantages are avoided by using fuel additives for keeping valves and carburetor or injection systems clean (cf. for example: M. Rossenbeck in Katalysatoren, Tenside, Mineralöladditive, editors J. Falbe, U. Hasserodt, page 223, G. Thieme Verlag, Stuttgart 1978). A distinction is now made between two generations, depending on the mode of action and preferred place of action of such detergent additives. The first generation of additives could only prevent the formation of deposits in the intake system but could not remove existing deposits. On the other hand, the additives of the second generation can prevent and eliminate deposits (keep-clean and clean-up effect). This is permitted in particular by their excellent heat stability in zones of high temperature, in particular at the intake valves.

The molecular structural principle of these additives of the second generation which act as detergents is based on the linking of polar structures with generally higher molecular weight nonpolar or oleophilic radicals.

Typical members of the second generation of additives are products based on polyisobutene in the nonpolar molecular moiety, in particular additives of the polyisobutylamine type. Such detergents can be prepared by two different multistage synthesis processes, starting from polyisobutenes: the first process takes place via chlorination of the polymeric parent structure, followed by nucleophilic substitution of the polymeric parent structure by amines or preferably ammonia. The disadvantage of this process is the use of chlorine, which results in the occurrence of chlorine- or chloride-containing products, which is now by no means desirable. In the second process, the polyisobutylamines are prepared starting from polyisobutene, by hydroformylation and subsequent reductive amination according to EP-A-0 244 616.

Detergent additives, which may originate from a large number of chemical classes of substances, are used in general in combination with a carrier oil. The carrier oils have an additional "washing function", often support and promote the detergents in their action and can help to reduce the required amount of detergent. Specific detergents do not display their action at all until they are combined with a carrier liquid. Usually, viscous, high-boiling and in particular heat-stable liquids are used as carrier oils. They coat the hot metal surface (for example the intake valve) with a thin liquid film and thus prevent or delay to a certain degree the formation or deposition of decomposition products on the metal surfaces, but without being able to replace the detergent additive components.

Suitable carrier oils for the fuels for internal combustion engines are, for example, high-boiling refined mineral oil fractions, as well as synthetic liquids. Suitable mineral carrier oils are, for example, fractions obtained in mineral oil processing.

Examples of suitable synthetic carrier oils are polyolefins, (poly)esters, (poly)alkoxylates, and in particular aliphatic polyethers, aliphatic polyetheramines, alkylphenol-initiated polyethers and alkylphenol-initiated polyetheramines.

Adducts of butylene oxide with alcohols have excellent solubility in fuels but are comparatively expensive products and the starting material butylene oxide has to be prepared by a relatively expensive procedure.

More economical carrier oils can be made available in the form of adducts of propylene oxide with alcohols.

EP-A-0 704 519 describes propoxylates as carrier oil components in combination with a high molecular weight amine and a hydrocarbon polymer.

EP-A-0 374 461 describes such propoxylates for use as a carrier oil in combination with esters of mono- or polycarboxylic acids and alcohols or polyols and amino- or amido-containing detergents. EP-A-0 374 461 expressly states (cf. page 4, line 29 et seq.) that the sole use of the propoxylates described therein reduces the intake valve deposits only to an insufficient extent, namely to values of from 80 to 220 mg per valve.

However, the known additive systems of the prior art which contain carrier oils based on propylene oxide still do not have the optimum cleaning effect in the engine. Furthermore, such adducts of propylene oxide with alcohols often give rise to problems owing to their limited solubility in fuels and owing to their poor compatibility with other additives, so that separation may occur. This effect is displayed in a particularly dramatic way when additive concentrates—additive systems are usually marketed as such—are to be formulated.

SUMMARY OF THE INVENTION

It is an object of the present invention to provide novel fuel compositions having improved properties for internal combustion engines. In particular, the novel fuel compositions should lead to substantially reduced intake valve deposits.

We have found, surprisingly, that this object is achieved by the provision of a fuel composition for internal combustion engines, comprising a principle amount of a liquid hydrocarbon fuel and an amount, which has a cleaning effect, in particular reduces intake valve deposits, of at least one propoxylate additive of the formula I

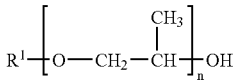

(I)

where n is an integer from 10 to 20 and $R^1$ is straight-chain or branched $C_8$-$C_{18}$-alkyl or $C_8$-$C_{18}$-alkenyl, preferably $C_8$-$C_{18}$-alkyl.

DETAILED DESCRIPTION OF PREFERRED EMBODIMENTS

The novel fuel compositions have the surprising advantage that they reduce deposits in the region of the intake valves substantially better than the corresponding shorter-chain or longer-chain propoxylates. This is surprising in particular because it has been assumed to date that compounds of the type used are suitable only as carrier oils for fuel compositions but carrier oils per se do not have a satisfactory cleaning effect in the intake system.

To achieve the effect shown according to the invention, the propoxylates of the above formula I should be used in an amount of from about 50 to 5000, preferably from about 100 to 2500, in particular from about 300 to 1000, mg/kg of fuel.

The above object according to the invention is furthermore achieved by providing fuel compositions for internal combustion engines which contain a principle amount of a liquid hydrocarbon fuel and an amount, which has a cleaning effect and substantially reduces impurities in the intake system, of an additive combination comprising:

i) at least one propoxylate additive, preferably an alkanol propoxylate, of the above formula I and ii) at least one detergent additive.

The novel fuel compositions which contain the above-mentioned additive combination also surprisingly substantially reduce intake valve deposits.

Examples of suitable detergent additives ii) are those that show a detergent effect or are anti valve seat recession additives, especially those with at least one hydrophobic hydrocarbon group and a number average molecular weight ($M_N$) of 85 to 20,000 and at least one polar, preferably terminal grouping selected from (a) mono- or polyamino groups with up to 6 nitrogen atoms, at least one of which has basic properties, (b) nitro groups, if required in combination with hydroxyl groups, (c) hydroxyl groups in combination with mono- or polyamino groups, wherein at least one nitrogen atom has basic properties, (d) carboxyl groups or the alkali metal or alkaline earth metal salts thereof, (e) sulfonic groups or the alkali metal or alkaline earth metal salts thereof, (f) polyoxy-$C_2$-$C_4$-alkylene groupings with hydroxyl groups, mono- or polyamino groups, wherein at least one nitrogen atom has basic properties, or carbamate groups in terminal position, (g) carboxylic acid ester groups, (h) groupings with hydroxy and/or amino and/or amido and/or imido groups derived from succinic anhydride, and (i) groupings prepared by means of Mannich reaction of substituted phenols with aldehydes and mono- or polyamines.

The hydrophobic hydrocarbon group preferably has a number average molecular weight ($M_N$) of 113 to 10,000, especially of 300 to 5,000. Typical hydrophobic hydrocarbon groups, especially in combination with the polar groupings (a), (c), (h) and (i), are the polypropenyl, polybutenyl and polyisobutenyl residues with $M_N$ of 300 to 5000, especially 500 to 2500 and in particular 750 to 2250.

Examples of additives containing mono- or polyamino groups (a) are preferably polyalkenmono- or polyalkenpolyamines based upon polypropene or highly reactive (i.e. with mostly terminal double bonds, especially in the α or β positions) or conventional (i.e. with mostly central double bonds) polybutene or polyisobutene with $M_N$ of 300 to 5000. Such additives on the basis of highly reactive polyisobutene, which may be produced from polyisobutene which may contain up to 20% by weight of n-butene units by means of hydroformylation and reductive amination with ammonia, monoamines or polyamines, such as dimethylaminopropyl amine, ethylenediamine, diethylenetriamine, triethylenetetramine or tetraethylenepentamine, are especially known from EP-A-0 244 616. If polybutene or polyisobutene with mostly central double bonds (mainly in β or γ positions) are used in the production of the additives, the preferred method of production is that of chlorination followed by amination or by oxidizing with air or ozone to yield carbonyl or carboxyl compounds and subsequent amination under reductive (hydrogenating) conditions. The amines used for amination may be the same as those mentioned above for the reductive amination of the hydroformylated highly reactive polyisobutene. WO 94/24231 especially describes corresponding additives on the basis of polypropene.

Preferred examples of amine additives of this type are polyalkyl amines of formula II $$R^2—NH_2 \quad (II)$$

where $R^2$ is a straight-chain or branched polyalkyl radical having a number average molecular weight of from about 500 to 5000.

Further preferred additives containing monoamino groups (a) are the hydrogenation products of the reaction products of polyisobutenes with an average degree of polymerization P of 5 to 100 with nitric oxides or mixtures of nitric oxides and oxygen as particularly described in WO-A-97/03946.

Further preferred additives containing monoamino groups (a) are the compounds obtainable from polyisobutenepoxides by reacting these with amines and subsequent dehydrogenation and reduction of the amino alcohols, as particularly described in DE-A 196 20 262.

Additives containing nitro groups, if required in combination with hydroxyl groups, (b) are preferably the reaction products of polyisobutenes with an average degree of polymerization P of 5 to 100 or 10 to 100 with nitric oxides or mixtures of nitric oxides and oxygen, as particularly described in WO-A-96/03367 and WO-A-96/03479. These reaction products are in general mixtures of pure nitropolyisobutanes (e.g. α,β-dinitropolyisobutane) and mixed hydroxynitropolyisobutanes (e.g. α-nitro-β-hydroxypolyisobutane).

Additives containing hydroxyl groups in combination with mono- or polyamino groups in particular are the reaction products of polyisobutene epoxides, which preferably may be obtained from polyisobutene with $M_N$=300 to 5000 and having mostly terminal double bonds, with ammonia, mono- or polyamines, as particularly described in EP-A-0 476 485.

Additives containing carboxyl groups and the alkali metal or alkaline earth metal salts thereof (d) are preferably copolymers of $C_2$-$C_{40}$ olefins with maleic anhydride with a total mole mass of 500 to 20,000, whose carboxyl groups are wholly or partly reacted to yield the alkali metal or alkaline earth metal salts and a remaining part of the carboxyl groups is reacted with alcohols or amines. Such additives are particularly known from EP-A-0 307 815. Such additives are mainly known as anti valve seat recession additives and may be used advantageously in combination with conventional fuel detergents, such as poly(iso)butenamines or polyetheramines, as described in WO-A-87/01126.

Additives containing sulfonic groups or the alkali metal or alkaline earth metal salts thereof (e) are preferably alkali metal or alkaline earth metal salts of a sulfosuccinic acid alkyl ester, as particularly described in EP-A-0 639 632. Such additives are mainly known as anti valve seat recession additives and may be used advantageously in combination with conventional fuel detergents, such as poly(iso)butenamines or polyetheramines.

Additives containing polyoxy-$C_2$-$C_4$-alkylene groupings (f) are preferably polyethers or polyetheramines which are obtainable by reacting $C_2$-$C_{60}$-alkanols, $C_6$-$C_{30}$-alkane diols, mono- or di-$C_2$-$C_{30}$-alkyl amines, $C_1$-$C_{30}$-alkyl cyclohexanols or $C_1$-$C_{30}$-alkyl phenols with 1 to 30 moles of ethylene oxide and/or propylene oxide and/or butylene oxide per hydroxyl group or amino group and, in the case of polyetheramines, followed by reductive amination with ammonia, monoamines or polyamines. Such products in particular are described in EP-A-0 310 875, EP-A-0 356 725, EP-A-0 700 985 and U.S. Pat. No. 4,877,416. In the case of polyethers such products also fulfill the properties of carrier oils. Typical examples thereof are tridecanol- or isotridecanol butoxylates, isononylphenol butoxylates as well as polyisobutenol butoxylates and propoxylates as well as the corresponding reaction products with ammonia.

Additives containing carboxylic acid ester groups (g) are preferably esters of mono-, di- or tricarboxylic acids with long-chain alkanols or polyols, especially those with a minimum viscosity of 2 $mm^2/s$ at 100° C., as they are described in particular in DE-A-38 38 918. Aliphatic or aromatic acids may be used as mono-, di- or tricarboxylic acids and suitable ester alcohols and polyols are in particular long-chain representatives with, for example, 6 to 24 carbon atoms. Typical esters are the adipates, phthalates, isophthalates, terephthalates and trimellitates of isooctanol, isononanol, isodecanol and isotridecanol. Such products also fulfill the properties of carrier oils.

Additives containing groupings derived from succinic anhydride with hydroxy and/or amino and/or amido and/or imido groups (h) are preferably corresponding derivatives of polyisobutenyl succinic anhydride, which are obtainable by reacting conventional or highly reactive polyisobutene with $M_N$=300 to 5000 with maleic acid anhydride either thermally or via chlorinated polyisobutene. In this respect, derivatives with aliphatic polyamines, like ethylenediamine, diethylenetriamine, triethylenetetramine or tetraethylenepentamine, are particularly interesting. In particular, such motor fuel additives are described in U.S. Pat. No. 4,849,572.

Additives containing groupings produced by Mannich reaction of substituted phenols with aldehydes and mono- or polyamines (i) are preferably reaction products of polyisobutene-substituted phenols with formaldehyde and mono- or polyamines, like ethylene diamine, diethylene triamine, triethylene tetraamine, tetraethylene pentamine or dimethylaminopropyl amine. The polyisobutenyl-substituted phenols may be derived from conventional or highly reactive polyisobutene with $M_N$=300 to 5000. In particular, such "polyisobutene Mannich bases" are described in EP-A-0 831 141.

For an exact definition of the individually listed additives, explicit reference is made to the specifications of the above mentioned prior art literature.

In the fuel compositions according to the second embodiment described above, the additives i) and the additives ii), as for example of the formula II, together are present in a total amount of from about 100 to 10,000, preferably from about 300 to 5000, in particular from about 500 to 3000, mg/kg of fuel. The additives i) and ii) and especially those of the formula I and those of the formula II are present in a molar ratio of from about 1:10 to 10:1, for example from about 1:5 to about 5:1, in particular from about 1:2 to 2:1.

Suitable $C_8$-$C_{18}$-alkyl radicals in the additives of formula I according to the invention are straight-chain or branched, saturated carbon chains of 8 to 18 carbon atoms. For example, the following radicals may be mentioned: n-hexyl, 1-, 2- or 3-methylpentyl, straight-chain heptyl, octyl, nonyl, decyl, undecyl, dodecyl, tridecyl, tetradecyl, pentadecyl, hexadecyl, heptadecyl and octadecyl and the singly or multiply branched analogs thereof. Preferred long-chain radicals are branched or straight-chain $C_{10}$-$C_{16}$-alkyl, in particular $C_{12}$-$C_{14}$-alkyl. Tridecyl radicals are especially preferred.

Suitable $C_8$-$C_{18}$-alkenyl radicals in the additives of formula I according to the invention are straight-chain or branched carbon chains having at least one carbon-carbon double bond and 8 to 18 carbon atoms. Examples of monounsaturated $C_8$-$C_{18}$-alkenyl radicals are radicals such as straight-chain octenyl, nonenyl, decenyl, undecenyl, dodecenyl, tridecenyl, pentadecenyl, hexadecenyl, heptadecenyl and octadecenyl and the branched analogs thereof, it being possible for the double bond to occur in any desired position. Also included according to the invention are both the cis- and the trans-isomers of the above $C_8$-$C_{18}$-alkenyl radicals. Preferred monounsaturated long-chain radicals are the $C_{10}$-$C_{16}$-alkenyl radicals.

Suitable polyalkyl radicals in additives of formula II according to the invention are preferably obtainable by homo- or copolymerization of the straight-chain or branched $C_2$-$C_{30}$-alkenes, $C_2$-$C_6$-alkenes and in particular $C_2$-$C_4$-alkenes being preferred. Particularly preferred $C_2$-$C_4$-alkenes are 1-alkenes, such as propylene, 1-butene and isobutene. The number average molecular weight of such polyalkyl radicals is roughly in the range from 500 to 5000, preferably from about 800 to 1500, in particular about 1000. For example, the polyalkyl radical may be derived from a copolymer of 1-butene and isobutene, and, for example, have a number average molecular weight of from about 800 to about 1500.

Propoxylates of the formula I which are particularly preferred according to the invention are compounds in which $R^1$ is straight-chain or branched alkyl of 10 to 16 carbon atoms, or mixtures thereof. Particularly preferred propoxylates of the formula I are those in which the radical $R^1$ is alkyl of 12 to 14 carbon atoms or is a mixture of such alkyl radicals. A propoxylate of the formula I in which the radical $R^1$ has 13 carbon atoms is particularly preferred.

A further group of propoxylates preferred according to the invention comprises those composed of from 12 to 18 repeating units, in particular from 14 to 17 and especially from 14 to 16 repeating units, of the formula

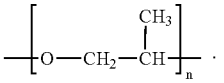

The most preferred class of propoxylates comprises those having 15 repeating propoxylate units. It must be borne in mind that the above numerical data for n may also be average values since many of the known preparation methods for such adducts of alkylene oxides with alcohols usually lead to a product mixture with varying molecular weight distribution.

Alkoxylates of the formula I which are most preferred according to the invention are adducts of from 14 to 16, in particular 15, propylene oxide units of the above formula with a branched $C_{13}$-alcohol, in particular $C_{13}$-monoalcohol. Branched $C_{13}$-alcohols which may be used according to the invention are, for example, also obtainable by oligomerization of $C_2$-$C_6$-olefins, in particular $C_3$- or $C_4$-olefins, and subsequent hydroformylation. A reaction mixture which may be obtained thereby and which may comprise, for example, different alcohol isomers can be used directly for the preparation of the additive components used according to the invention. However, prior separation of the reaction mixture can, if required, also be carried out.

The preferred alkanol propoxylates according to the invention are prepared in the conventional manner by reacting an alcohol, as an initiator molecule, with propylene oxide in the presence of an alkali, e.g. sodium hydroxide solution, potassium hydroxide solution, sodium methylate, potassium methylate or another alkali metal alkoxide, at from about 120 to 160° C., preferably from about 130 to 160° C., to give the desired adducts. After alkoxylation is complete, the propoxylate is freed from the catalyst, for example by treatment with magnesium silicate. The preparation is thus carried out analogously to the phenol-initiated alkoxylates described in DE-A-41 42 241.

The polyalkylamines of the formula II are compounds known per se and can be prepared by hydroformylation of reactive polyalkenes and subsequent reductive amination of the oxo product. The reactive polyalkenes having an average molecular weight of from about 500 to 5000, are homo- or copolymers of straight-chain or branched $C_2$-$C_{30}$-alkenes, preferably $C_2$-$C_6$-alkenes, in particular $C_2$-$C_4$-alkenes. Reactive polyalkenes comprise unsaturated polymers of high chemical homogeneity, more than 10% of the double bonds being in the alpha position. One possibility for the preparation of reactive polyalkenes is disclosed in DE-A-27 02 604. Particularly preferred reactive polyalkenes are those which are prepared from 1-alkenes, in particular propylene, 1-butene, isobutene or mixtures thereof.

Suitable polyalkylamines of the formula II are also amines according to EP-A-0 244 616 and EP-A-0 695 338, the content of which is hereby expressly incorporated by reference. EP-A-0 244 616 describes in particular those polyalkylamines in which $R^2$ is derived from isobutene and up to 20% by weight of n-butene. EP-A-0 695 338 describes in particular those polyalkylamines in which $R^2$ is derived from one or more 1-n-alkenes of 3-6 carbon atoms and up to 50% by weight of ethene.

Novel fuel compositions comprise both diesel fuels and fuels for gasoline engines. Suitable fuels for gasoline engines are leaded and in particular unleaded regular and premium grade gasoline. The gasolines may also contain components other than hydrocarbons, for example alcohols, such as methanol, ethanol and tert-butanol, and ethers, e.g. methyl tert-butyl ether. In addition to the additives of the above formula I and, if required, II, the novel fuel compositions may contain further additive components.

Further additives which may be used according to the invention are described, for example, in European Patent Applications EP-A-0 277 345, 0 356 725, 0 476 485, 0 484 736, 0 539 821, 0 543 225, 0 548 617, 0 561 214, 0 567 810 and 0 568 873; in German Patent Applications DE-A-39 42 860, 43 09 074, 43 09 271, 43 13 088, 44 12 489, 44 25 834, 195 25 938, 196 06 845, 196 06 846, 196 15 404, 196 06 844, 196 16 569, 196 18 270 and 196 14 349; and in WO-A-96/03479.

Particularly useful liquid detergent additives are sold by BASF AG, Ludwigshafen, under the tradename Kerocom® PIBA. These contain polyisobutenamines dissolved in aliphatic $C_{10-14}$-hydrocarbons.

In addition to the above additives, further conventional fuel additives may be present, for example corrosion inhibitors, demulsifiers, stabilizers, antioxidants, antistats, metallocenes, like ferrocene or methylcyclopentadienylmanganesetricarbonyl, lubricity additives, and dyes (markers).

Corrosion inhibitors are generally ammonium salts of organic carboxylic acids which, by virtue of the starting compound having the appropriate structure, tend to form films. Amines for reducing the pH are also frequently used in corrosion inhibitors or may be added as such to the fuel. Heterocyclic aromatics are generally used as corrosion inhibitors for nonferrous metals.

Examples of antioxidants or stabilizers are in particular amines, such as para-phenylenediamine, dicyclohexylamine, morpholine or derivatives of these amines. Phenolic antioxidants, such as 2,4-di-tert-butylphenol or 3,5-di-tert-butyl-4-hydroxyphenyl-propionic acid and derivatives thereof, are also added to fuels.

The demulsifiers used are usually salts of fatty acids and sulfonic acids.

Examples of lubricity additives are certain carboxylic acids or fatty acids, alkenylsuccinic esters, bis(hydroxyalkyl) fatty amines, hydroxyacetoamides or castor oil. For example, suitable lubricity additives are described in EP-A-0 780 460, 0 829 527, 0 869 163, 0 605 857, WO 97/45507, 98/30658 and U.S. Pat. Nos. 5,756,435 and 5,505,867, which are explicitly incorporated by reference. The aforementioned carboxylic acids or fatty acids may be present as monomer and/or dimeric species.

If required, carrier oils may furthermore be added, the carrier oils differing from the compounds of the formula I.

Examples of useful carrier oils or carrier liquids are mineral carrier oils, synthetic carrier oils and mixtures thereof which are compatible with the above additive or additives and with the fuel. Suitable mineral carrier oils are fractions obtained in mineral oil processing, such as kerosene or naphtha, brightstock or mineral oils having a viscosity of SN 500-900, as well as aromatic hydrocarbons, paraffinic hydrocarbons and alkoxyalkanols.

Examples of suitable synthetic carrier oils are polyolefins, (poly)esters, (poly)alkoxylates, and in particular aliphatic polyethers, aliphatic polyetheramines, alkylphenol-initiated polyethers and alkylphenol-initiated polyetheramines. Suitable carrier oil systems are described, for example, in DE-A-38 38 918, DE-A-38 26 608, DE-A-41 42 241, DE-A-43 09 074, U.S. Pat. No. 4,877,416 and EP-A-0 452 328. Examples of particularly suitable synthetic carrier oils are alcohol-initiated polyethers having from about 20 to 25 $C_3$-$C_6$-alkylene oxide units, for example selected from propylene oxide units, n-butylene oxide units and isobutylene oxide units or mixtures thereof.

Examples of suitable additive combinations for fuels are combinations of at least one propoxylate as defined in formula I above, at least one detergent additive as defined, for example, in formula II above, at least one lubricity additive as defined above and/or, if required, at least one corrosion inhibitor as defined above.

The present invention furthermore relates to fuel additive mixtures which are preferably present in the form of additive concentrates and, as intake valve cleaner components, contain at least one propoxylate additive of the formula I according to the above definition, in particular an alkanol propoxylate of the above formula I, if required in combination with at least one polyalkylamine of the formula II according to the above definition and, if required, at least one further other fuel additive. According to a preferred embodiment, the novel fuel additive mixtures contain propoxylate and polyalkylamine in a molar ratio stated above for the novel fuel compositions.

The present invention furthermore relates to the use of at least one propoxylate of the above formula I, if required in combination with at least one detergent additive as defined above, in particular at least one polyalkylamine of the above formula II, as an intake valve cleaner additive for fuel compositions for internal combustion engines.

The examples which follow illustrate the invention in more detail.

EXAMPLES

Example 1

Engine Test for Testing the Action as Intake System Cleaner

The engine tests were carried out in a 1.2 l Opel Kadett engine according to CEC F/04/A/87. Fuel used: unleaded European premium grade.

The additives used were prepared by the following general method.

A dewatered mixture of the alcohol used as initiator and KOH is initially taken in a pressure-resistant vessel, the amount of KOH used being from about 0.01 to 1, preferably from 0.05 to 0.5, % by weight of the expected total weight of the reaction product. The apparatus is then flushed several times with nitrogen and is heated to about 135° C. and the propylene oxide is then metered in while stirring at a constant temperature and at a pressure of from 3 to 30 bar via a dip tube or onto the surface. After metering is complete, the reaction mixture is further stirred until the pressure remains constant. After the reactor content has been cooled to about 50° C., the reaction vessel is let down and is flushed with nitrogen. The product is freed from volatile components, advantageously under reduced pressure, and, if necessary, clarified by filtration. Before the filtration, it is advantageously removed from the catalyst by methods known to a person skilled in the art, for example treatment with ion exchanger, precipitation or absorption, etc.

TABLE 1

| Additive | Dose [mg/kg] | Intake valve deposits [mg][1)] Valves 1 | 2 | 3 | 4 |
|---|---|---|---|---|---|
| Tridecanol × 10 Propylene oxide | 400 | 13 (277) | 2 (175) | 11 (183) | 58 (337) |
| Tridecanol × 15 Propylene oxide | 400 | 4 (277) | 0 (175) | 1 (183) | 0 (337) |
| Tridecanol × 20 Propylene oxide | 400 | 17 (277) | 0 (175) | 0 (183) | 22 (337) |
| Tridecanol × 25 Propylene oxide | 400 | 144 (514) | 34 (303) | 305 (300) | 41 (519) |
| Tridecanol × 30 Propylene oxide | 400 | 160 (514) | 2 (303) | 28 (300) | 86 (519) |

[1)]Values in brackets: Deposits without addition of additives; the different values are due to differences in the unleaded European premium grade used

Example 2

Cooperation of Tridecanol Propoxylate and Polyisobutenamine

The following test results (engine: Mercedes Benz M 102 E) show that a maximum effect is also achieved with a tridecanol propoxylate with 15 mol of propylene oxide. In a polyisobutenamine-containing fuel additive package (PIBA content 25% by weight) the carrier oil component was varied in the manner stated.

TABLE 2

| Additive | Dose* [mg/kg] | Intake valve deposits [mg]* Valves 1 | 2 | 3 | 4 |
|---|---|---|---|---|---|
| Starting value | — | 283 | 132 | 232 | 290 |
| Tridecanol × 15 propylene oxide | 500 | 7 | 10 | 89 | 19 |
| Tridecanol × 25 propylene oxide | 500 | 59 | 97 | 39 | 40 |

*Dose of a formulation comprising propoxylate and PIBA in a weight ratio of about 1:1; total amount of PIBA + propoxylate in the formulation is 50% by weight.

Example 3

Compatibility Investigation

The following test results show that a tridecanol propoxylate with 15 mol of propylene oxide has optimum compatibility with the components of an additive package (concentrate).

In a polyisobutenamine-containing fuel additive package, the carrier oil component was replaced with the novel tridecanol propoxylate with 15 mol of propylene oxide or with a corresponding propoxylate not according to the invention and comprising 25 mol of propylene oxide. The formulation with the novel component was homogeneous whereas phase separation occurred in the comparative formulation when left to stand at 20° C.

We claim:

1. A method of improving the intake system cleaning effect of a fuel composition for internal combustion engines, the method consisting of:

(a) providing the fuel composition with an effective amount of (i) a propoxylate additive of formula I

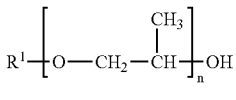

(I)

wherein n is an integer of from 14-17, and $R^1$ is straight-chain or branched $C_8$-$C_{18}$-alkyl or $C_8$-$C_{18}$-alkenyl; or (b) providing the fuel composition with an effective amount of (i) a propoxylate additive of formula I and with (ii) at least one detergent additive, selected from a polyalkylamine additive of the formula II $$R^2—NH_2 \quad (II)$$

where $R^2$ is a straight-chain or branched polyalkyl radical having a number average molecular weight of from about 500 to about 5000.

2. The method as claimed in claim 1, wherein in said propoxylate additive of formula I, n is an integer of 15 and $R^1$ is straight-chain or branched $C_{13}$-alkyl.

3. The method of claim 1, wherein n in formula I is 15.

4. The method as claimed in claim 1, in which the propoxylate of formula I is added in an amount of from 50 to 5000 mg/kg of fuel.

5. The method as claimed in claim 1, wherein the additives i) and ii) are used in a total amount of from about 100 to about 10000 mg/kg of fuel.

6. The method as claimed in claim 1, wherein the additives i) and ii) are used in a molar ratio of from about 1:10 to about 10:1.

7. The method as claimed in claim 1, wherein in said polyalkylamine additive of the formula II, $R^2$ is a radical derived from identical or different $C_2$-$C_{30}$-alkenes.

8. The method as claimed in claim 1, wherein said additive of formula II is at least one polyisobutenamine having a number average molecular weight of from 800 to 1500.

9. The method as claimed in claim 1, wherein in said propoxylate additive of formula I, $R^1$ is straight-chain or branched $C_{13}$-alkyl.

10. The method as claimed in claim 1, wherein in said propoxylate additive of formula I, $R^1$ is a straight-chain or branched $C_{10}$-$C_{16}$-alkyl or $C_{10}$-$C_{16}$-alkenyl.

11. The method as claimed in claim 1, wherein in said propoxylate additive of formula I, $R^1$ is a straight-chain or branched $C_{12}$-$C_{14}$-alkyl or $C_{12}$-$C_{14}$-alkenyl.

12. The method as claimed in claim 1, in which the propoxylate of formula I is added in an amount of from 300 to 5000 mg/kg of fuel.

* * * * *